US008602412B2

(12) United States Patent
Ma

(10) Patent No.: US 8,602,412 B2
(45) Date of Patent: Dec. 10, 2013

(54) PAPER-COLLECTING APPARATUS FOR PRINTING APPARATUS

(75) Inventor: Chin-Ta Ma, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 152 days.

(21) Appl. No.: 13/329,441

(22) Filed: Dec. 19, 2011

(65) Prior Publication Data

US 2013/0009360 A1 Jan. 10, 2013

(30) Foreign Application Priority Data

Jul. 7, 2011 (TW) ..... 100124121 A

(51) Int. Cl.
*B65H 31/00* (2006.01)

(52) U.S. Cl.
USPC ..... 271/207; 271/223; 271/213; 271/145; 271/171

(58) Field of Classification Search
USPC ..... 271/223, 171, 145, 207, 213
See application file for complete search history.

(56) References Cited

U.S. PATENT DOCUMENTS

| | | | | |
|---|---|---|---|---|
| 6,053,493 | A * | 4/2000 | Yokoyama et al. | 271/171 |
| 6,231,043 | B1 * | 5/2001 | James et al. | 271/209 |
| 6,296,407 | B1 * | 10/2001 | McKay et al. | 400/624 |
| 6,729,616 | B2 * | 5/2004 | Chen | 271/213 |
| D518,094 | S * | 3/2006 | Nakayama et al. | D18/55 |
| 7,070,350 | B2 * | 7/2006 | Inokuchi et al. | 400/680 |
| 8,348,263 | B2 * | 1/2013 | Otani et al. | 271/213 |
| 8,448,942 | B2 * | 5/2013 | Otani et al. | 271/213 |
| 2010/0124449 | A1 * | 5/2010 | Asada et al. | 399/393 |

* cited by examiner

*Primary Examiner* — Michael McCullough
*Assistant Examiner* — Howard Sanders
(74) *Attorney, Agent, or Firm* — Altis Law Group, Inc.

(57) ABSTRACT

A paper-collecting apparatus for printing apparatuses is disclosed. The paper-collecting apparatus comprises a fixing board having two first protrusion portions; a first paper holding tray having two first hooks, and two second protrusion portions; wherein each of the two first hooks corresponds to each of the two first protrusion portions; and each of the two second protrusion portions is beside each of the two first hooks; and a second paper holding tray having two second hooks; wherein each of the two second hooks corresponds to each of the two second protrusion portions, wherein the first paper holding tray is fixed on to the fixing board by each of the two first hooks engages with each of the two first protrusion portions; and the second paper tray is fixed on to the first paper tray by each of the two second hooks engages with each of the two second protrusion portions.

15 Claims, 9 Drawing Sheets

PAPER-COLLECTING APPARATUS FOR PRINTING APPARATUS

BACKGROUND

1. Technical Field

The present disclosure relates to a paper-collecting apparatus for printing apparatuses.

2. Description of Related Art

A printing apparatus, such as a printer or a photocopying machine, takes a sheet of paper from an input tray, prints an image on the sheet of paper, and discharges the printed sheet to an output tray. A paper collecting apparatus may comprises a number of paper holding trays stacked together to support stacks of paper of different specifications. A number of hooks are horizontally located on the number of paper holding trays. When one of the paper holding trays is pulled, all the paper holding trays come out together, which may be inconvenient for a uses.

Therefore there is a need for improvement in the art.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
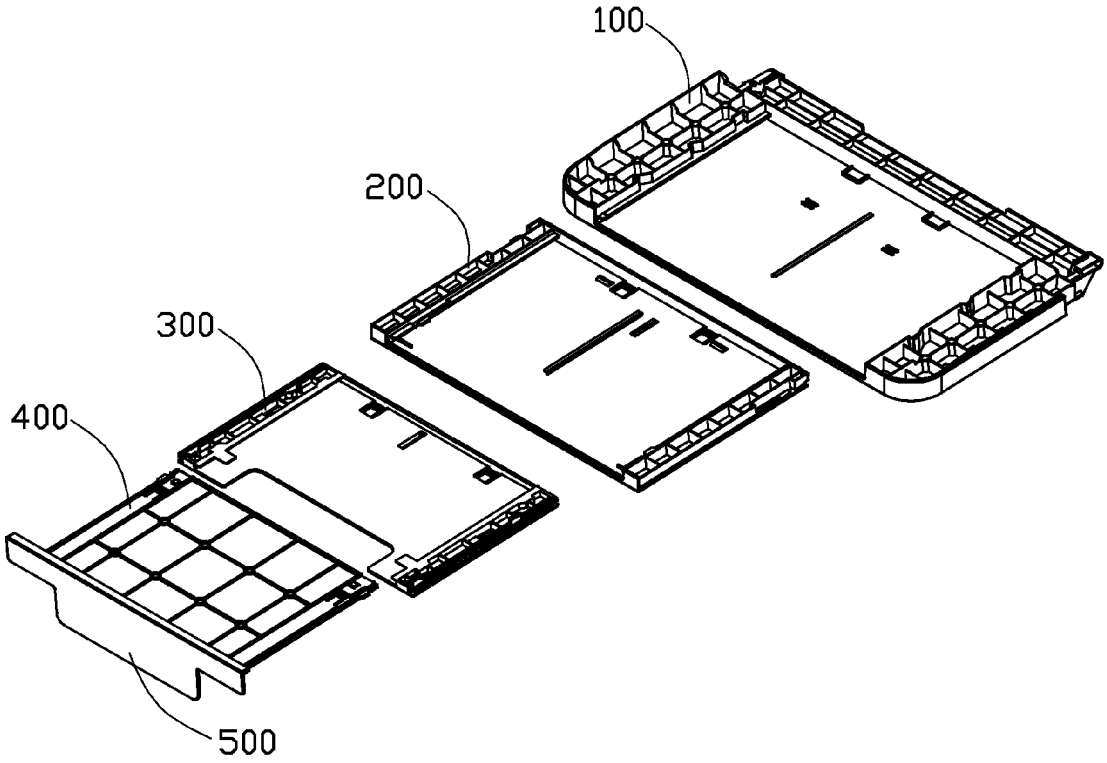
FIG. 1 is an isometric and exploded view of an exemplary embodiment of a paper-collecting apparatus for printing apparatuses; the paper-collecting apparatus comprises a fixing board, a first paper holding tray, a second paper holding tray, a third paper holding tray and a paper stopping tray.

Referring to FIG. 1, a paper-collecting apparatus for collecting printed papers dropped at a paper output port of a printing apparatus (not shown) is shown. The paper-collecting apparatus comprises a fixing board 100, a first paper holding tray 200, a second paper holding tray 300, a third paper holding tray 400 and a paper stopping tray 500.

Figure 2:
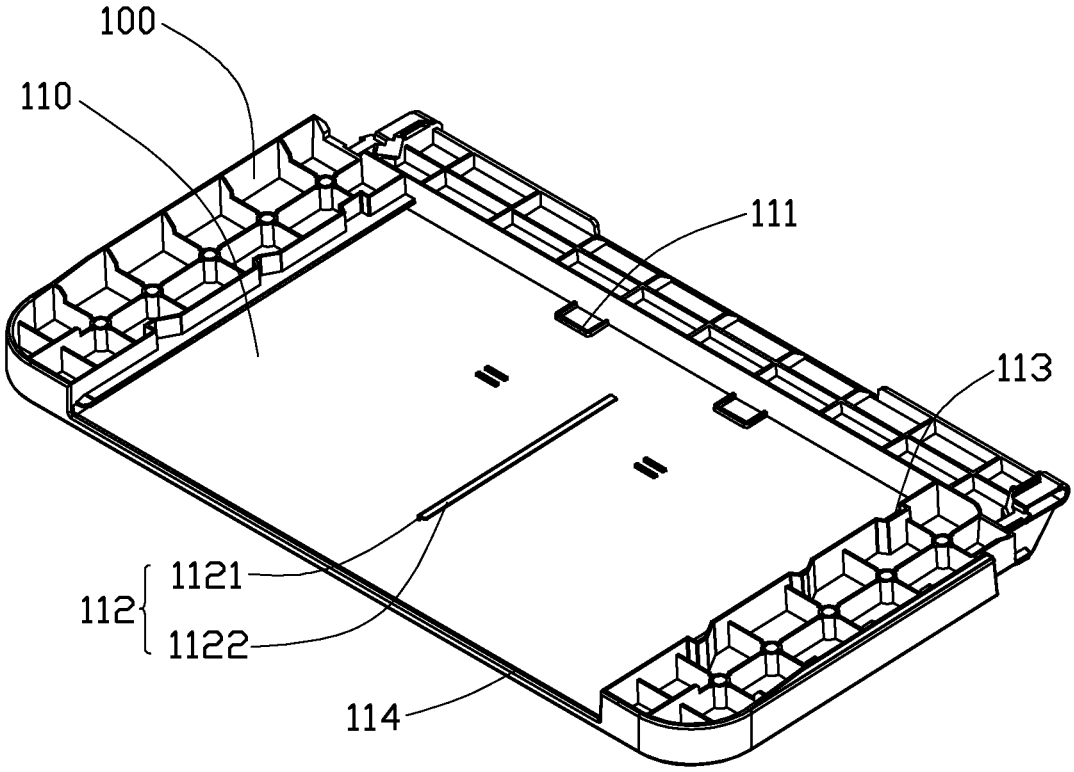
FIG. 2 is an isometric view of the fixing board of FIG. 1.

Referring to FIG. 2, a front of the fixing board 100 is fixed on the paper output port of the printing apparatus. The fixing board 100 comprises a first top surface 110 defining two first protrusion portions 111 thereon. Each of the two first protrusion portions 11 is U-shaped. A first guiding portion 112 is positioned on a middle of the first top surface 110. The first guiding portion 112 comprises a first connection wall 1121 extending perpendicularly from the first top surface 110, and a first top wall 1122 extending horizontally from a side edge of the first connection wall 1121. A plurality of first engaging slots 113 are defined on two sides of the first top surface 110. Each of the plurality of first engaging slots 113 is trapezium-shaped. A first resisting portion 114 extends upwardly from a back edge of the first top surface 110.

Figure 3:
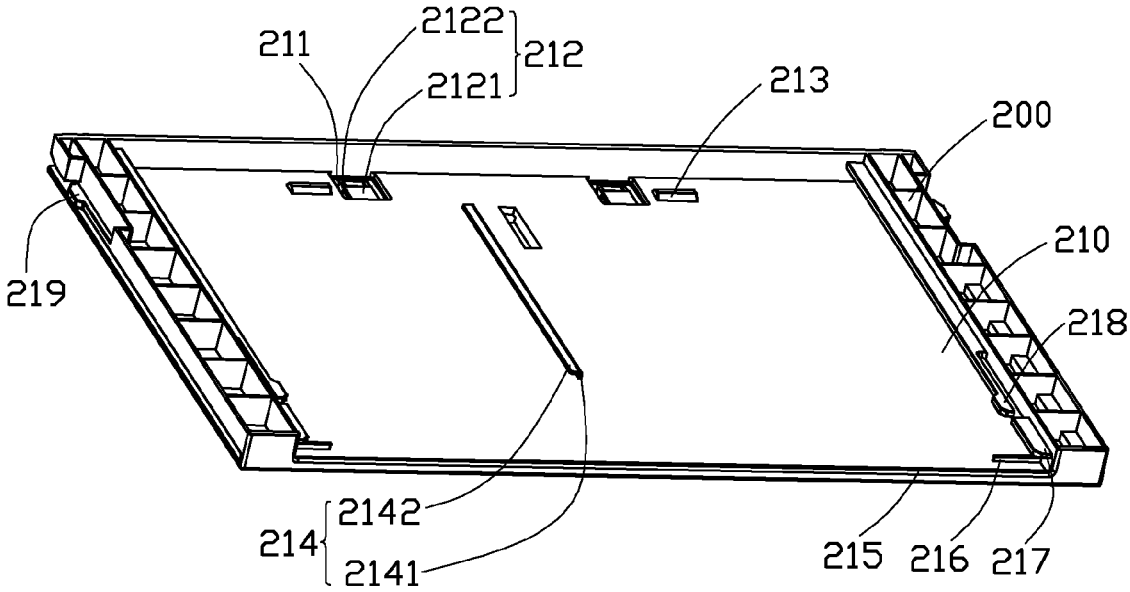
FIG. 3 is an isometric view of the first paper holding tray of FIG. 1.
Figure 4:
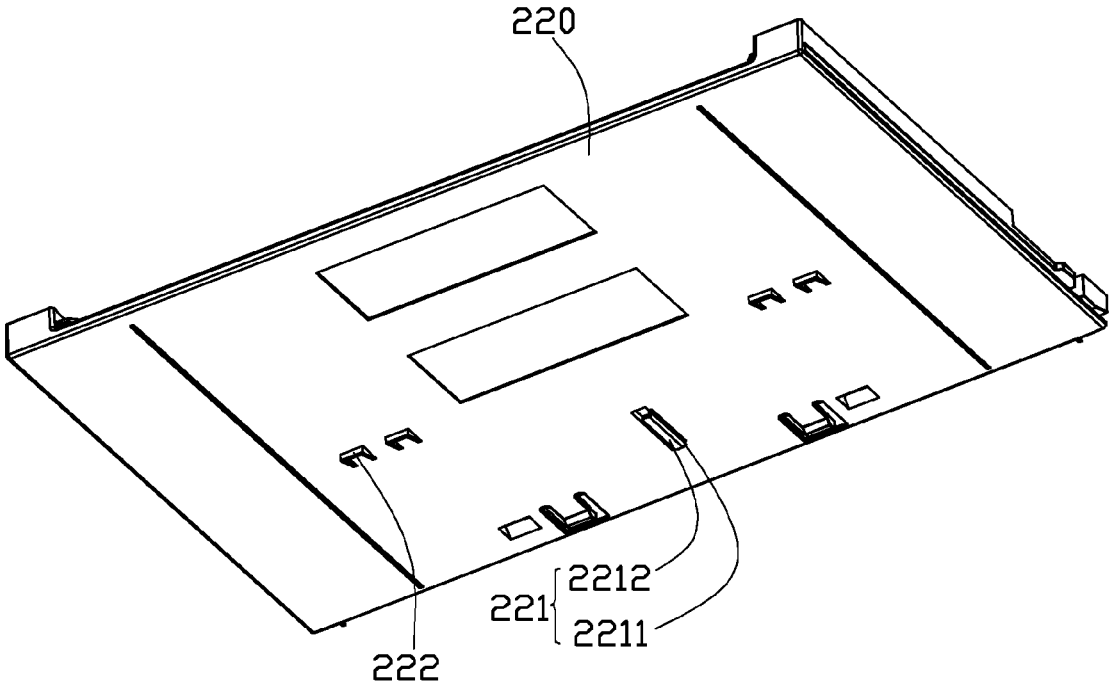
FIG. 4 is an isometric view of the first paper holding tray of FIG. 3, viewed from another aspect.

Referring to FIGS. 3 and 4, the first paper holding tray 200 comprises a second top surface 210 and a second bottom surface 220. Two first openings 211 are defined on a front of the second top surface 210. A first hook 212 extends horizontally from a lower edge of each of the two first openings 211 corresponding to the two first protrusion portions 111. The first hook 212 comprises a first elastic slice 2121 extending horizontally from the lower edge of the corresponding first opening 211, and a trapezium-shaped first engaging portion 2122 extending downwardly from a distal end of the first elastic slice 2121. The first engaging portion 2122 is trapezium-shaped. A second protrusion portion 213 extends upwardly from the second top surface 210 on one side of each of the two first openings 211. The second protrusion portion 213 is trapezium-shaped. A second guiding portion 214 is positioned on a middle of the second top surface 210. The second guiding portion 214 comprises a second connection wall 2141 extending perpendicularly from the second top surface 210, and a second top wall 2142 extending horizontally from a side edge of the second connection wall 2141. A second resisting portion 215 extends upwardly from a back edge of the second top surface 210.

A third protrusion portion 216 is positioned on each of the two sides of the second top surface 210, adjacent to the second resisting portion 215. A guiding block 217 is positioned beyond the third protrusion portion 216 on each of the two sides of the second top surface 210. Both the third protrusion portion 216 and the guiding block 217 are bar-shaped. A first engaging block 218 is positioned on the second top surface 210 adjacent to the guiding block 217. A second engaging block 219 corresponding to the first engaging slots 113, is positioned on each of the two sides of the second top surface 210. Both the first engaging block 218 and the second engaging block 219 are trapezium-shaped. A third guiding portion 221 corresponding to the first guiding portion 112, is positioned on a middle of the second bottom surface 220. The third guiding portion 221 comprises a third connection wall 2211 extending perpendicularly from the second bottom surface 220, and a first bottom wall 2212 extending horizontally from a side edge of the third connection wall 2211. A plurality of wedge-shaped first resisting blocks 222 corresponding to the first resisting portion 114, are positioned on the second bottom surface 220. Each of the plurality of first resisting blocks 222 is wedge-shaped.

Figure 5:
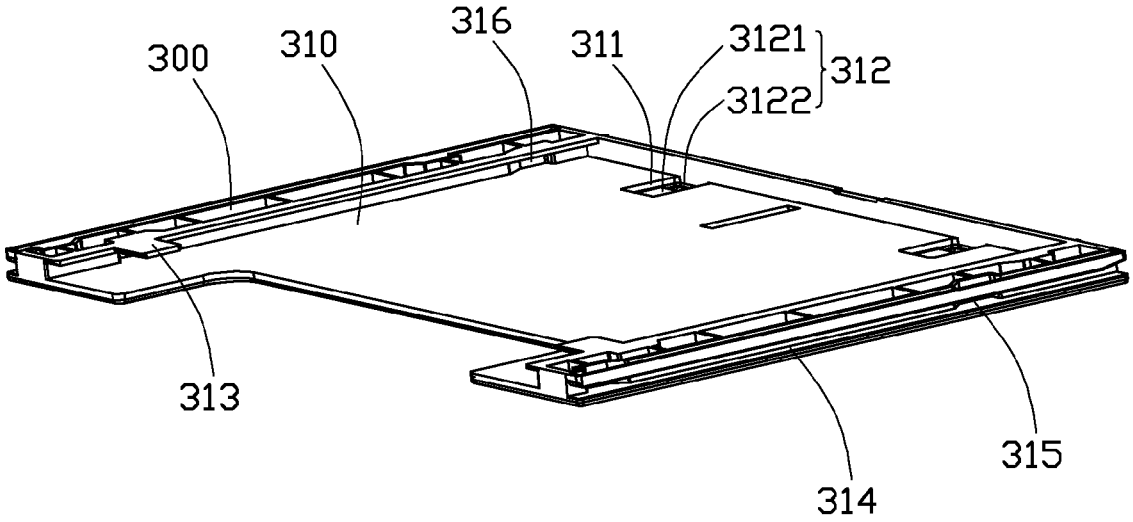
FIG. 5 is an isometric view of the second paper holding tray of FIG. 1.
Figure 6:
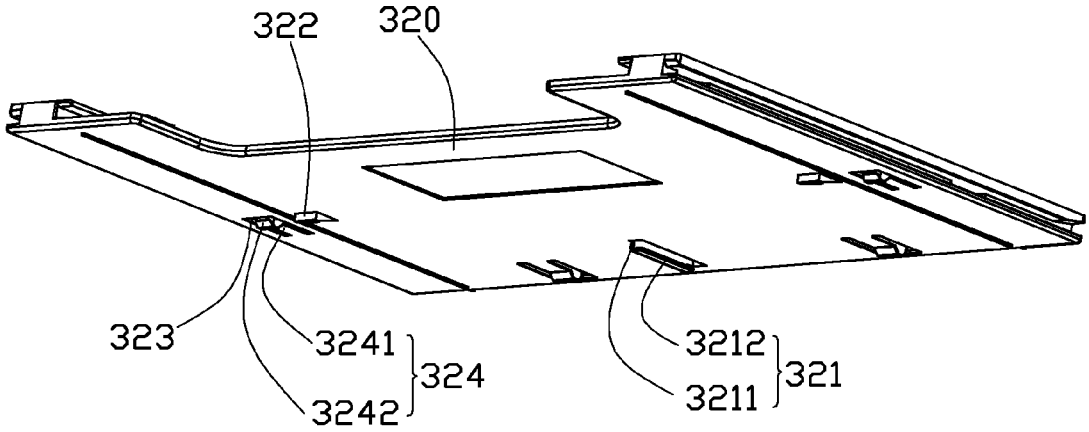
FIG. 6 is an isometric view of the second paper holding tray of FIG. 5, viewed from another aspect.

Referring to FIGS. 5 and 6, the second paper holding tray 300 comprises a third top surface 310 and a third bottom surface 320. Two second openings 311 are defined on a front of the third top surface 310. A second hook 312 extends horizontally from a lower edge of each of the two second openings 311. The second hook 312 corresponds to each of the two first protrusion portions 111. The second hook 312 comprises a second elastic slice 3121 extending horizontally from the lower edge of each of the two second opening 311, and a second engaging portion 3122 extending downwardly from a distal end of the second elastic slice 3121. The second engaging portion 3122 is trapezium-shaped. Two second resisting blocks 313 are positioned on a back of the third top surface 310. Each of the two second resisting blocks is bar-shaped. A guiding slot 314 corresponding to the guiding blocks 217, is defined on each of the two sides of the third top surface 310. A plurality of second engaging slots 315 corresponding to the first engaging block 218, are defined in the guiding slot 314. A plurality of third engaging slots 316 are defined on the third top surface 310. Each of the plurality of third engaging slots 316 is trapezium-shaped.

A fourth guiding portion 321 corresponding to the second guiding portion 214, is positioned on a middle of the third bottom surface 320. The fourth guiding portion 321 comprises a fourth connection wall 3211 extending perpendicularly from the third bottom surface 320, and a fourth bottom wall 3212 extending horizontally from a side edge of the fourth connection wall 3211. A third resisting blocks 322 corresponding to each of the second resisting portion 215, is positioned on the third bottom surface 320. The third resisting blocks is wedge-shaped. A third opening 323 is defined on the third bottom surface 320 beside each third resisting block 322. A third hook 324 corresponding to the third protrusion portion 216, extends horizontally from the lower edge of each third opening 323. The third hook 324 comprises a third elastic slice 3241 extending horizontally from the lower edge of the third opening 323, and a third engaging portion 3242 extending downwardly from a distal end of the third elastic slice 3241. The third engaging portion 3242 is trapezium-shaped.

Figure 7:
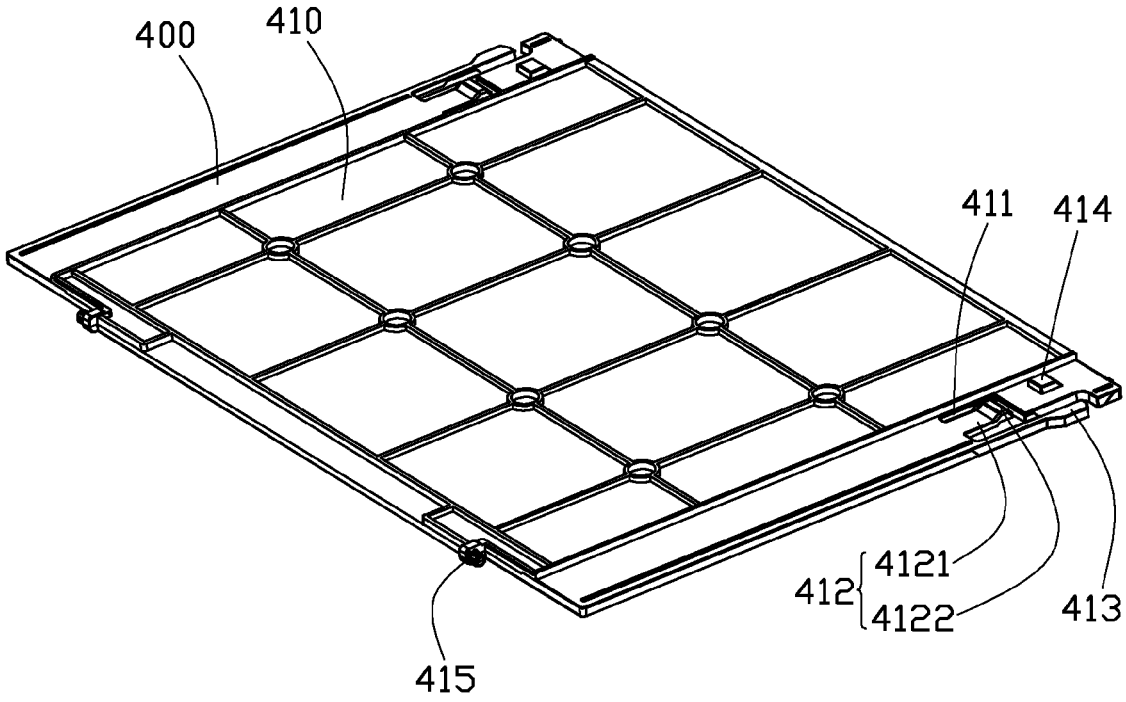
FIG. 7 is an isometric view of the third paper holding tray of FIG. 1.

Referring to FIG. 7, the third paper holding tray 400 comprises a fourth top surface 410. Two fourth opening 411 are defined on a front of the fourth top surface 410. A fourth hook 412 corresponding to each of the two second resisting blocks 313, extends horizontally from a lower edge of each of the two fourth openings 411. Each fourth hook 412 comprises a fourth elastic slice 4121 extending horizontally from the lower edge of the fourth opening 411, and a trapezium-shaped fourth engaging portion 4122 extending downwardly from a distal end of the fourth elastic slice 4121. The forth engaging portion 4122 is trapezium-shaped. A third engaging block 413, corresponding to the third engaging slots 316, extends horizontally from the lower edge of each of the two fourth openings 411, adjacent to the fourth hook 412. A fourth protrusion portion 414 extends upwardly from the fourth top surface 410 adjacent to the third engaging block 413. The fourth protrusion portion 414 corresponds to each of the two second resisting blocks 313. The fourth protrusion portion 414 is trapezium-shaped. Two column-shaped pivoting portions 415 extend from a back of the fourth top surface 410.

Figure 8:
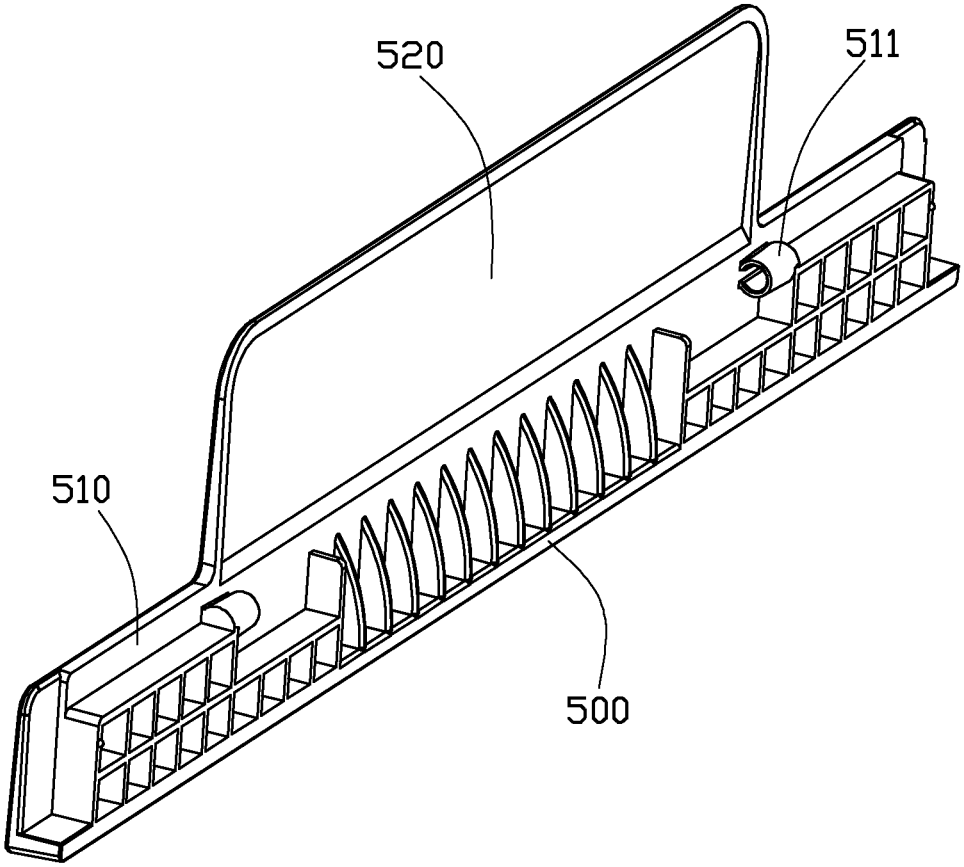
FIG. 8 is an isometric view of the paper stopping tray of FIG. 1.
Figure 9:
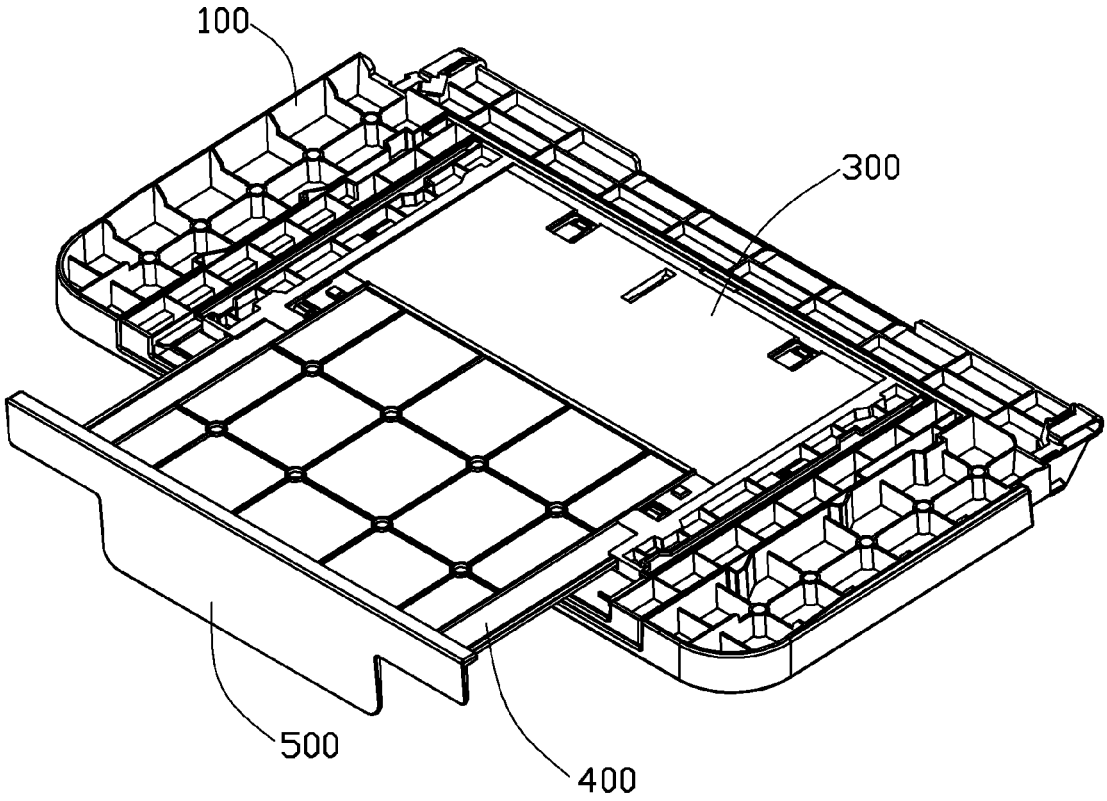
FIG. 9 is an assembly view of the paper-collecting apparatus of FIG. 1.

Referring to FIG. 8, the paper stopping tray 500 comprises a pivoting board 510, and a paper stopping board 520 extending from a middle of the pivoting board 510. Two ring-shaped pivoting holes 511 corresponding to the two pivoting portions 415, are defined on the pivoting board 510. In one embodiment, a thickness of each of the two first protrusion portions 111 is greater than a thickness of the second protrusion portions 213. The thickness of the second protrusion portions 213 is greater than a thickness of the fourth engaging portions 4122. The thickness of the fourth engaging portion 4122 is greater than a thickness of the third protrusion portions 216.

Referring to FIGS. 1 to 9, in assembly, the first paper holding tray 200 is positioned on the fixing board 100. The third guiding portion 221 engages the first guiding portion 112. The first engaging portion 2122 engages the first protrusion portions 111. The second engaging blocks 219 engage the first engaging slots 113 to fix the first paper holding tray 200 on the fixing board 100. The second paper holding tray 300 is positioned on the first paper holding tray 200. The fourth guiding portion 321 engages the second guiding portion 214. The second engaging portions 3122 engage the second protrusion portions 213. The guiding blocks 217 slide in the guiding slots 314 to fix the second paper holding tray 300 on the first paper holding tray 200. The third paper holding tray 400 is positioned on the second paper holding tray 300. The third engaging blocks 413 engage the third engaging slots 316 to fix the third paper holding tray 400 on the second paper holding tray 300. The pivoting board 510 contacts a back of the third paper holding tray 400. The pivoting portions 415 engage the pivoting holes 511 to fix the paper stopping tray 500 on the third paper holding tray 400.

When any of the first paper holding tray 200, the second paper holding tray 300 and the third paper holding tray 400 are pulled out, the engaging strength between the first engaging portion 2122 and the first protrusion portions 111 is greater than that between the second engaging portions 3122 and the second protrusion portions 213. The engaging strength between the second engaging portions 3122 and the second protrusion portions 213 is greater than that between the fourth engaging portion 4122 and the second resisting blocks 313. The third paper holding tray 400 is pulled out first until the fourth protrusion portion 414 resists the second resisting block 313. When the second engaging portions 3122 disengage from the second protrusion portions 213, the second paper holding tray 300 is pulled out until the third engaging portions 3242 disengage from the third protrusion portions 216. The third resisting blocks 322 resist the second resisting portion 215. When the first engaging portion 2122 disengages from the first protrusion portions 111, the first paper holding tray 200 is pulled out until the first resisting blocks 222 resist the first resisting portion 114.

When any of the first paper holding tray 200, the second paper holding tray 300 and the third paper holding tray 400 are pushed home, the engaging strength between the fourth engaging portion 4122 and the second resisting blocks 313 is greater than that between the third engaging portions 3242 and the third protrusion portions 216. The engaging strength between the third engaging portions 3242 and the third protrusion portions 216 is greater than the friction between the first paper holding tray 200 and the fixing board 100. The first paper holding tray 200 is pushed back first until the first engaging portion 2122 engages the first protrusion portions 111. The second paper holding tray 300 is then pushed back until the third engaging portions 3242 engage the third protrusion portions 216. The third paper holding tray 400 is finally pushed back.

Even though numerous characteristics and advantages of the present disclosure have been set forth in the foregoing description, together with details of the structure and function of the disclosure, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A paper-collecting apparatus, comprising:

a fixing board having two first protrusion portions;

a first paper holding tray having two first hooks, and two second protrusion portions;

wherein each of the two first hooks corresponds to each of the two first protrusion portions; and each of the two second protrusion portions is beside each of the two first hooks; and a second paper holding tray having two second hooks; wherein each of the two second hooks corresponds to each of the two second protrusion portions, wherein each of the two first hooks engages with each of the two first protrusion portions to fix the first paper holding tray onto the fixing board; and each of the two second hooks engages with each of the two second protrusion portions to fix the second paper holding tray onto the first paper holding tray; a first guiding portion is positioned on a middle of the fixing board; the first guiding portion comprises a first connection wall extending perpendicularly from the fixing board, and a first top wall extends horizontally from a side edge of the first connection wall; a first resisting portion extends upwardly from a back edge of the fixing board; the first paper holding tray comprises a second bottom surface; a third guiding portion is positioned on a middle of the second bottom surface corresponding to the first guiding portion; a plurality of wedge-shaped first resisting blocks is positioned on the second bottom surface corresponding to the first resisting portion; the third guiding portion is adapted to slide along the first guiding portion; and the first resisting blocks are adapted to resist the first resisting portion when the first paper holding tray is pulled out.

2. The paper-collecting apparatus of claim 1, wherein the first paper holding tray further comprises a second top surface, two bar-shaped third protrusion portions and a second resisting portion, each of the two bar-shaped third protrusion portions is adjacent to each side of the second resisting portions, on each side of the second top surface; two third hooks are positioned on the second paper holding tray corresponding to the two bar-shaped third protrusion portions; and the two third hooks are adapted to engage the two bar-shaped third protrusion portions when the second paper holding tray is pulled out.

3. The paper-collecting apparatus of claim 2, wherein the second top surface defines a second guiding portion on the middle; a second resisting portion extends upwardly from a back edge of the second top surface; the second paper holding tray comprises a third bottom surface; a fourth guiding portion is positioned on a middle of the third bottom surface corresponding to the second guiding portion;

two wedge-shaped third resisting blocks are positioned on the third bottom surface beside the third hooks corresponding to the second resisting portion; the fourth guiding portion is adapted to slide along the second guiding portion; and the third resisting blocks are adapted to resist the second resisting portion when the second paper holding tray is pulled out.

4. The paper-collecting apparatus of claim 3, wherein the second paper holding tray further comprises a third top surface; two bar-shaped second resisting blocks are positioned on a back of the third top surface; the paper-collecting apparatus further comprises a third paper holding tray having a fourth top surface; two fourth hooks are positioned on a front of the fourth top surface corresponding to the second resisting blocks; and the two fourth hooks are adapted to elastically resist the second resisting block when the third paper holding tray is pulled out.

5. The paper-collecting apparatus of claim 4, wherein a trapezium-shaped fourth protrusion portion extends upwardly from the fourth top surface adjacent to each fourth hook corresponding to the second resisting block; and the fourth protrusion portions are adapted to resist the second resisting blocks when the third paper holding tray is pulled out.

6. The paper-collecting apparatus of claim 5, wherein two column-shaped pivoting portions extend from a back of the fourth top surface; the paper stopping tray comprises a pivoting board and a paper stopping board extends from a middle of the pivoting board; two ring-shaped pivoting holes are defined on the pivoting board corresponding to the pivoting portions; and the pivoting portions is adapted to engage the pivoting holes to pivotally fix the paper stopping tray on the third paper holding tray.

7. The paper-collecting apparatus of claim 4, wherein each fourth hook comprises a fourth elastic slice extends horizontally from the fourth top surface and a trapezium-shaped fourth engaging portion extends downwardly from a distal end of the fourth elastic slice.

8. The paper-collecting apparatus of claim 7, wherein a thickness of the first protrusion portions is greater than that of the second protrusion portions; a thickness of the second protrusion portions is greater than that of the fourth engaging portions; and a thickness of the fourth engaging portion is greater than that of the third protrusion portions.

9. A paper-collecting apparatus, comprising:

a fixing board having two first protrusion portions;

a first paper holding tray having two first hooks, wherein each of the two first hooks corresponds to each of the two first protrusion portions; a second protrusion portion is positioned beside each of the two first hooks; and a second paper holding tray having two second hooks; wherein each of the two second hooks corresponds to each of the two second protrusion portions; two second resisting blocks are positioned on a back of the second paper holding tray; wherein each of the two first hooks engages with each of the two first protrusion portions to fix the first paper holding tray onto the fixing board; and each of the two second hooks engages with each of the second protrusion portions to fix the second paper holding tray onto the first paper holding tray; and a third paper holding tray having two fourth hooks, wherein each of the two fourth hooks corresponds to each of the two second resisting blocks; the two fourth hooks are adapted to elastically resist the second resisting block when the third paper holding tray is pulled out; a first guiding portion is positioned on a middle of the fixing board; the first guiding portion comprises a first connection wall extending perpendicularly from the fixing board, and a first top wall extends horizontally from a side edge of the first connection wall; a first resisting portion extends upwardly from a back edge of the fixing board; the first paper holding tray comprises a second bottom surface; a third guiding portion is positioned on a middle of the second bottom surface corresponding to the first guiding portion; a plurality of wedge-shaped first resisting blocks is positioned on the second bottom surface corresponding to the first resisting portion; the third guiding portion is adapted to slide along the first guiding portion; and the first resisting blocks are adapted to resist the first resisting portion when the first paper holding tray is pulled out.

10. The paper-collecting apparatus of claim 9, wherein the first paper holding tray further comprises a second top surface, two bar-shaped third protrusion portions and a second resisting portion, each of the two bar-shaped third protrusion portions is adjacent to each side of the second resisting portion, on each side of the second top surface; two third hooks are positioned on the second paper holding tray corresponding to the two bar-shaped third protrusion portions; and the two third hooks are adapted to engage the two bar-shaped third protrusion portions when the second paper holding tray is pulled out.

11. The paper-collecting apparatus of claim 10, wherein the second top surface defines a second guiding portion on the middle; a second resisting portion extends upwardly from a back edge of the second top surface; the second paper holding tray comprises a third bottom surface; a fourth guiding portion is positioned on a middle of the third bottom surface corresponding to the second guiding portion; two wedge-shaped third resisting blocks are positioned on the third bottom surface beside the third hooks corresponding to the second resisting portion; the fourth guiding portion is adapted to slide along the second guiding portion; and the third resisting blocks are adapted to resist the second resisting portion when the second paper holding tray is pulled out.

12. The paper-collecting apparatus of claim 11, wherein the third paper holding tray comprises a fourth top surface; a trapezium-shaped fourth protrusion portion extends upwardly from the fourth top surface adjacent to each fourth hook corresponding to the second resisting block; and the fourth protrusion portions are adapted to resist the second resisting blocks when the third paper holding tray is pulled out.

13. The paper-collecting apparatus of claim 12, wherein two column-shaped pivoting portions extend from a back of the fourth top surface; the paper stopping tray comprises a pivoting board and a paper stopping board extends from a middle of the pivoting board; two ring-shaped pivoting holes are defined on the pivoting board corresponding to the pivoting portions; and the pivoting portions is adapted to engage the pivoting holes to pivotally fix the paper stopping tray on the third paper holding tray.

14. The paper-collecting apparatus of claim 12, wherein each fourth hook comprises a fourth elastic slice extends horizontally from the fourth top surface and a trapezium-shaped fourth engaging portion extends downwardly from a distal end of the fourth elastic slice.

15. The paper-collecting apparatus of claim 14, wherein a thickness of the first protrusion portions is greater than that of the second protrusion portions; a thickness of the second protrusion portions is greater than that of the fourth engaging portions; and a thickness of the fourth engaging portion is greater than that of the third protrusion portions.

* * * * *